United States Patent [19]

Danko

[11] 4,321,875

[45] Mar. 30, 1982

[54] SUPPORT STRUCTURE

[76] Inventor: Peter J. Danko, 408 Gibbon St., Alexandria, Va. 22314

[21] Appl. No.: 95,943

[22] Filed: Nov. 20, 1979

[51] Int. Cl.[3] ..... A47B 13/02

[52] U.S. Cl. ..... 108/150; 108/153; 248/163 R

[58] Field of Search ..... 108/153, 150; 248/431, 248/163; D6/175

[56] References Cited

U.S. PATENT DOCUMENTS

| | | | |
|---|---|---|---|
| D. 125,002 | 2/1941 | Mildwoff | D6/175 |
| D. 135,508 | 4/1943 | Mildwoff | D6/175 |
| D. 238,407 | 1/1976 | Owens | D6/175 |
| 2,548,586 | 4/1951 | Bruner | 108/150 |
| 2,842,416 | 7/1958 | Davock | 108/153 |
| 3,224,719 | 12/1965 | Beckman | 248/163 |
| 3,731,639 | 5/1973 | Schliemann | 108/153 |
| 3,880,097 | 4/1975 | Camilleri | 108/153 |

FOREIGN PATENT DOCUMENTS

| | | | |
|---|---|---|---|
| 67873 | 5/1951 | Netherlands | 108/153 |
| 173939 | 1/1922 | United Kingdom | 108/150 |

*Primary Examiner*—Francis K. Zugel

*Attorney, Agent, or Firm*—Finnegan, Henderson, Farabow, Garrett & Dunner

[57] ABSTRACT

A support structure for use in furniture which is comprised of upper and lower support assemblies that are spatially separated one from the other by an even number of connecting panels. Alternate pairs of the panels converge with respect to the upper support assembly and alternate pairs of the panels converge with respect to the lower support assembly.

18 Claims, 11 Drawing Figures

Fig. 1
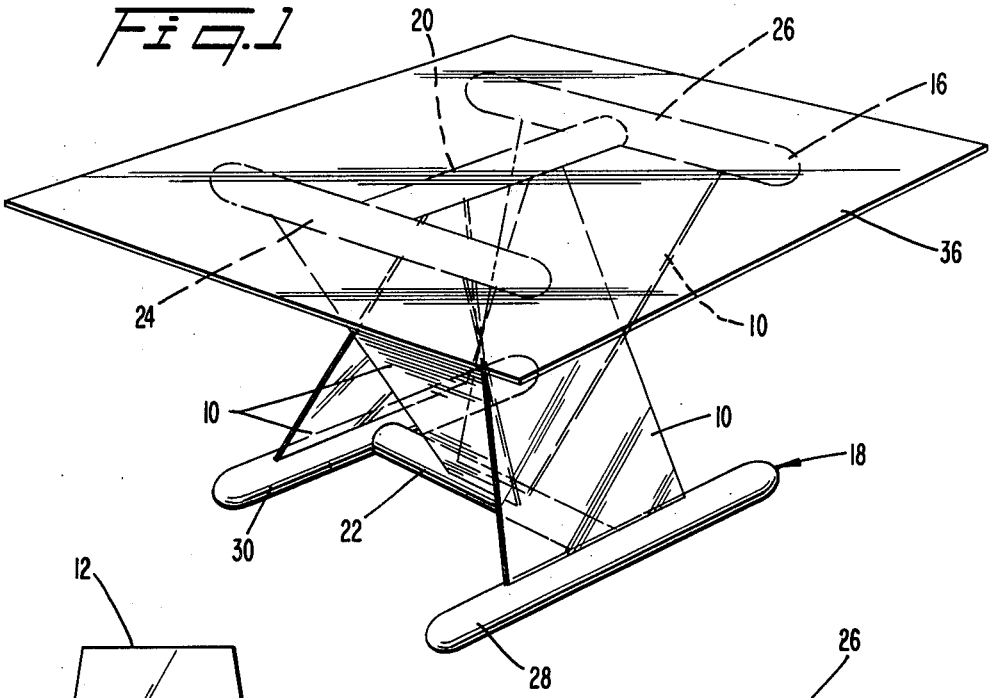
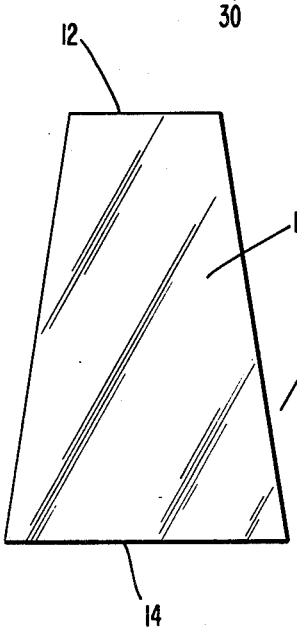
Fig. 4
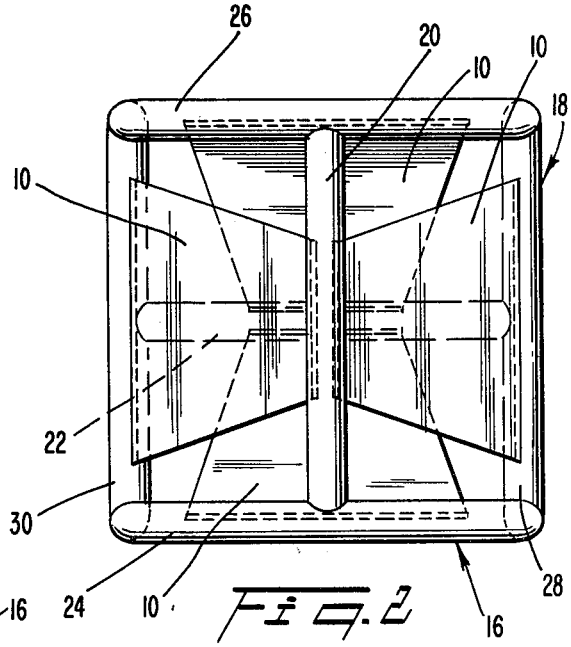
Fig. 2
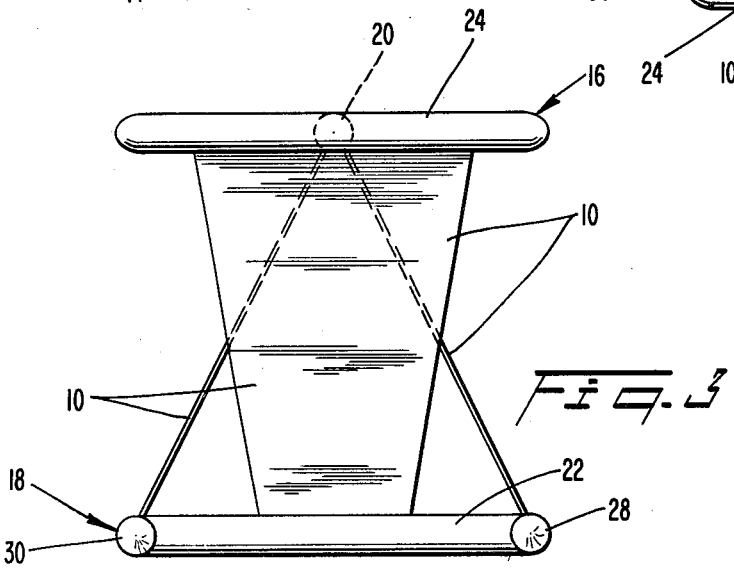
Fig. 3

Fig. 8
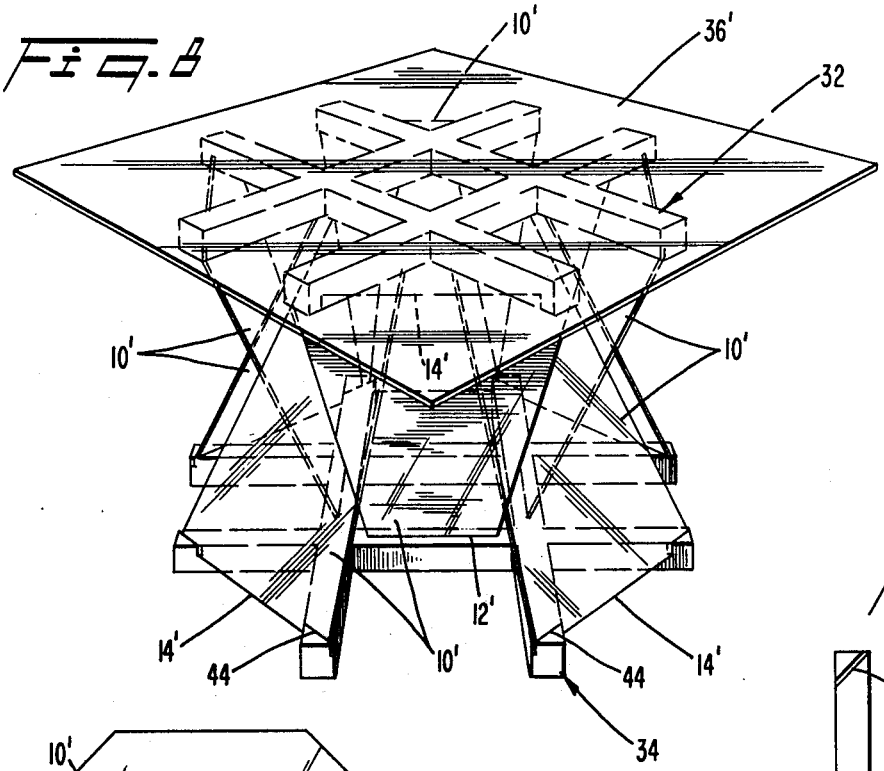
Fig. 9
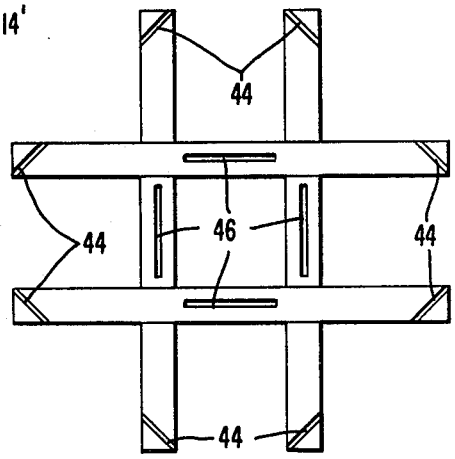
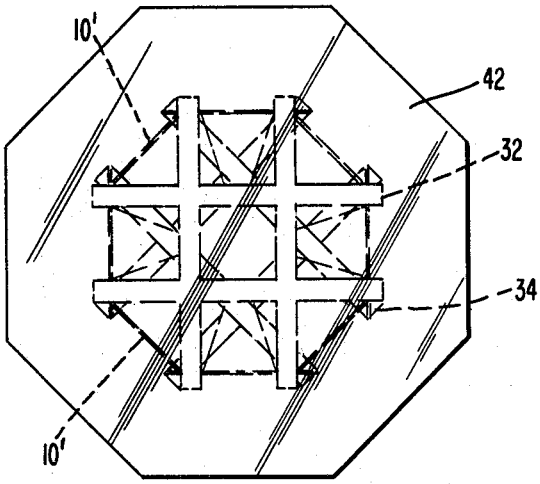
Fig. 10
Fig. 11
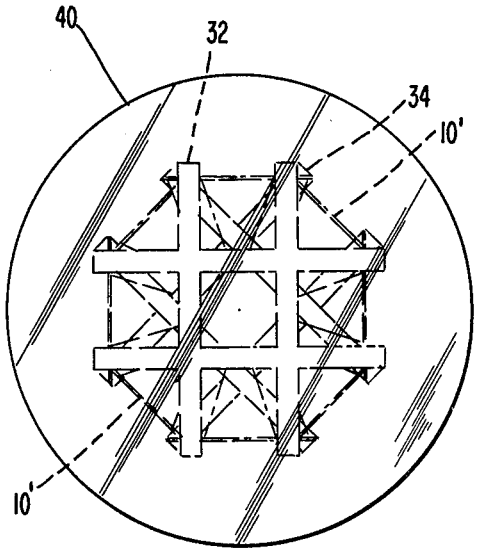

SUPPORT STRUCTURE

BACKGROUND OF THE INVENTION

The present invention relates to a support structure finding particular utility in the manufacture of furniture. Conceptually items of furniture such as tables and chairs involve the support of a substantially planar surface (e.g. a table top) above another substantially planar surface, the floor on which the item of furniture rests. Most conventional of such support means are, of course, simply elongated members i.e. legs.

The present invention does not use elongated legs for support, but instead uses inclined panel-like members connecting upper and lower support assemblies. Such a structure provides a strong, rigid support that is economical to manufacture. The panel-like members may be of identical shape and formed from conventional sheet material with little waste.

SUMMARY OF THE INVENTION

The present invention provides an improved furniture support structure comprised of an upper support assembly, a lower support assembly and an even number of panel-like members affixed to the upper and lower support assemblies. The panels number at least four with alternate pairs of the panel-like members converging with respect to the upper support assembly and alternate pairs of the panel-like members converging with respect to the lower support assembly.

Preferably, the panel-like members are trapezoidal with the opposite parallel sides of the trapezoidal members being affixed to the upper and lower support assemblies respectively.

It is further preferred that the panel-like members are inclined from the vertical at an angle in the range of from 10 to 40 degrees.

It is also preferred that the upper and lower support assemblies be parallel to one another with the upper support assembly supporting an upper planar surface comprising the surface of a table.

It is further preferred that where the structure includes four panel-like members the upper and lower support assemblies be H-shaped. The alternate pairs of converging panel-like members converge with respect to and are affixed to the connecting cross-bar member of the H of both the upper and lower support assemblies. In such an embodiment, the upper and lower support assemblies are rotated 90° from congruence.

The accompanying drawings which are incorporated in and constitute a part of this specification, illustrate several embodiments of the invention.

BRIEF DESCRIPTION OF THE DRAWINGS

FIG. 1 is a perspective view of a table embodiment of the invention comprised of upper and lower support assemblies, four panel-like members and a top.

FIG. 2 is a plan view of the support structure of FIG. 1 showing the relationship of the upper and lower H-shaped support assemblies and the four panel-like members.

FIG. 3 is a side view of the support structure of FIG. 2.

FIG. 4 depicts the shape of the panel-like member used in the embodiment of FIGS. 1–3.

FIG. 8 is a perspective view of a second table embodiment of the invention comprised of upper and lower support assemblies, eight panel-like members and a top.

FIG. 9 depicts the structure of the upper and lower support assemblies of the embodiment of FIG. 8.

FIGS. 10 and 11 are plan views of different table embodiments using the support structure of FIG. 8.

DESCRIPTION OF THE PREFERRED EMBODIMENT

Reference will now be made in detail to the present preferred embodiments of the invention, examples of which are illustrated in the accompanying drawings.

In accordance with the present invention, the furniture support structure of the present invention includes upper and lower support assemblies. As here embodied, and most clearly depicted in FIG. 3 the upper and lower supports are parallel to one another.

In accordance with the present invention, the furniture support structure includes an even number of panel-like members. The panel-like members are at least four in number and are affixed to the upper and lower support assemblies. Alternate pairs of panel-like members converge with respect to the upper support assembly and alternate pairs of the panel-like members converge with respect to lower support assembly.

Figure 5:
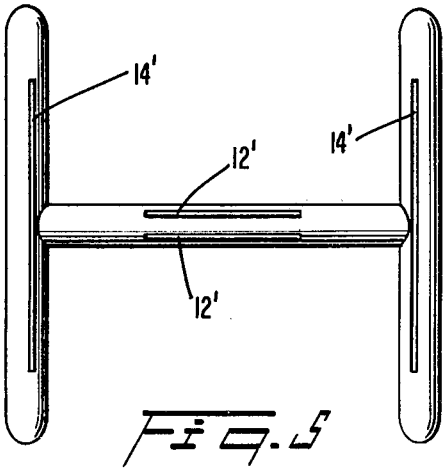
FIG. 5 depicts the structure of the upper and lower support assemblies of the embodiment of FIGS. 1–3.
Figure 7:
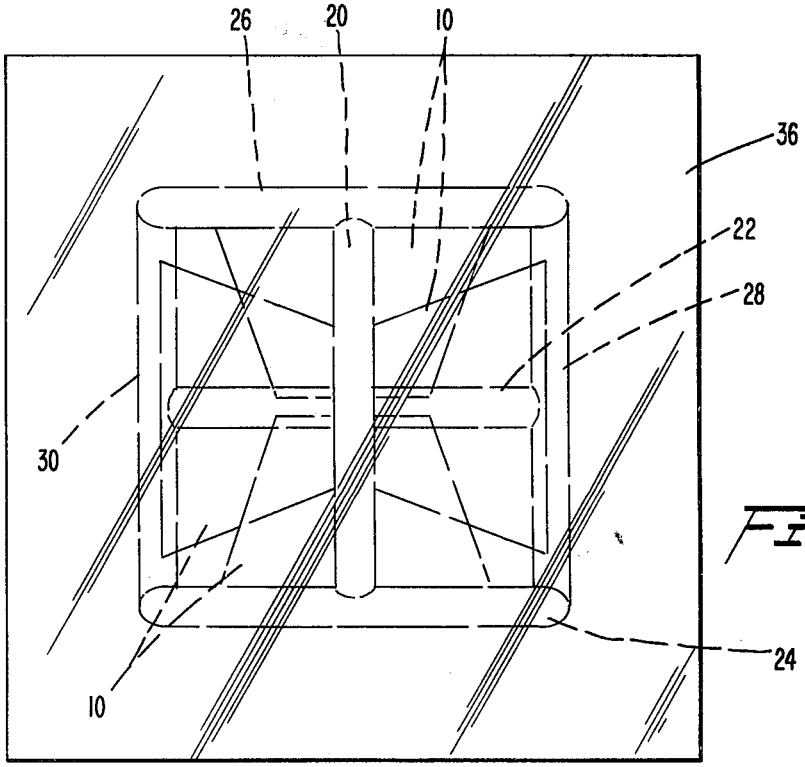
FIG. 7 is a plan view of the embodiment of FIG. 1.

As here embodied and depicted in FIGS. 1–4, the panel-like members are trapezoidal. In such an embodiment, the trapezoidal panel-like members 10 include opposite parallel sides 12 and 14, respectively. The opposite parallel sides are affixed to the upper support assembly 16 and lower support assembly 18. As depicted in FIG. 5, the preferred manner of affixing the panel-like members 10 to both the upper and lower support assemblies is to have the parallel sides of the panel-like members fit within grooves in the support assembly. As here embodied, the shorter sides 12 of the panel-like members 10 would fit into the slots 12' and the longer sides 14 would fit into the slots 14'.

In the preferred embodiment, the panel-like members are inclined from the vertical at an angle as most clearly depicted in FIG. 3, the angle ranges from 5° to 45°. It is further preferred that the panel-like members 10 be substantially transparent and in such embodiments glass or substantially transparent plastic may be used.

In the embodiment where the structure includes H-shaped upper and lower support assemblies, the furniture support includes four panel-like members. As shown in FIGS. 1–3, the converging panel-like members 10 are affixed to the upper connecting member 20 and the lower connecting member 22 of the H-shaped upper support assembly 16 and lower support assembly 18. As is most clearly depicted in FIG. 2, the upper and lower support assemblies 16 and 18 respectively are rotated 90° from congruence such that the upper and lower support assemblies are askew from one another.

As here embodied, the upper H-shaped support assembly 16 is comprised of two upper supporting members (24 and 26) and an upper connecting member 20. Each extremity of the upper connecting member 20 is affixed to the two upper supporting members 24 and 26, preferably at their midpoints. Similarly, the lower H-shaped support assembly 18 is comprised of two lower supporting members (28 and 30) and a lower connecting member 22. Each extremity of the lower connecting member 22 is affixed to the two lower supporting members 28 and 30, preferably at their midpoints.

In general, the angle by which the upper support assembly must be rotated to achieve congruence is 360° divides by the number of panels included in the structure. The embodiment of FIGS. 8–10 is also illustrative of this general principal. This embodiment includes eight (8) panels 10' and the upper support assembly 32 and the lower support assembly 34 are rotated 45° from congruence.

Figure 6:
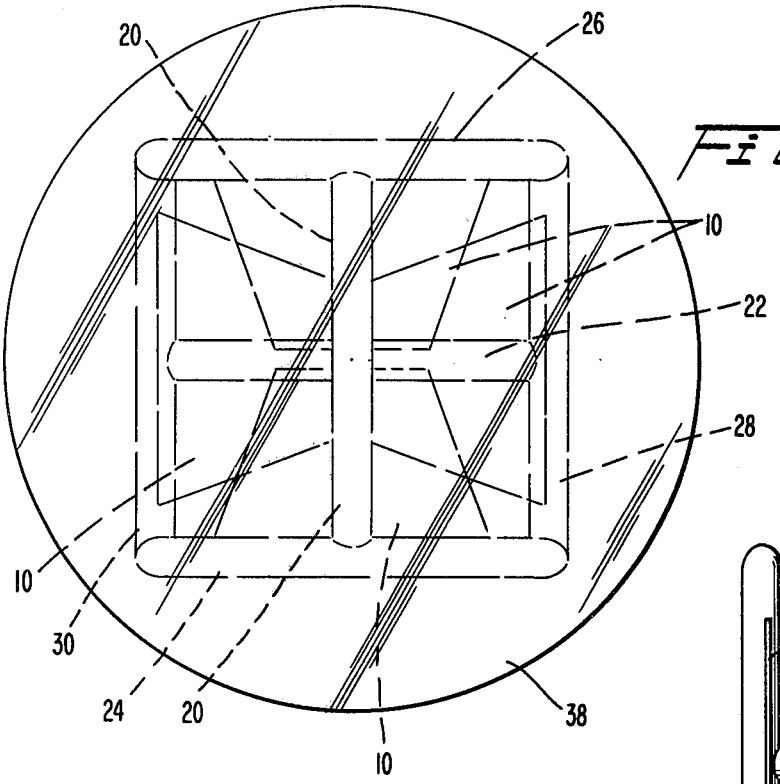
FIG. 6 is a plan view of a table embodiment utilizing the support structure of FIGS. 2 and 3.

As depicted in FIGS. L, 6, 7, 8, 10 and 11, the preferred embodiment of the support structure of the present invention is a table that includes a top. FIGS. 1 and 8 depict transparent square tops 36 and 36'. The shape of the top is a matter of design choice. FIGS. 6 and 11 depict round tops 38 and 40 respectively. FIG. 10 depicts an octagonal top 42.

Additional embodiments of the invention are depicted in FIGS. 8–11. In such embodiments, the support assemblies depicted in FIG. 9, are made up of a plurality of intersecting members. As previously disclosed, these embodiments include eight (8) panel-like members 10'. As a result, the upper support assembly 32 is rotated 45° from congruence with the lower support assembly 34 as is most clearly depicted in FIGS. 10 and 11.

In the same manner as the previous embodiment, the embodiments of FIGS. 8–11 have alternate pairs of panel-like members converging with respect to the upper support assembly and the lower support assembly. In the latter embodiments, the four panel-like member that converge on the central portion of the lower support assembly 34 are affixed at 90° to one another on that central portion. The four panels that are affixed to the outer portions of the lower support 34 are also at 90° to one another.

As depicted in FIG. 9, the panel-like members 10' are preferably affixed to the support members by means of grooves within the support member. In the embodiment depicted, the longer parallel side 14' of panel-like member 10' is affixed to the upper and lower support assemblies in grooves 44. The shorter parallel sides 12 fits within the grooves 46.

The embodiments shown herein are exemplary of the invention. The shapes of the components used are, in most case, matters of choice. For example, the shapes of the upper and lower support assemblies shown herein are preferred but other shapes may be used in connection with the invention. Similarly, the materials used for the support assemblies may be wood, tubular metal, plastic or the like. The panel-like members shown herein are trapezoidal but rectangular, square or other shapes could be used. Thus, it is intended that modifications and variations of the embodiments shown herein be within the scope of the invention as defined by the appended claims and their equivalents.

What is claimed is:

1. A furniture support structure comprising:

(a) an upper support assembly;

(b) a lower floor engaging support assembly;

(c) an even number of panel-like members formed of single planar sheets, said number being at least four, said panel-like members being affixed to said upper and lower support assemblies with alternate pairs of said panel-like members converging with respect to said upper support assembly and alternate pairs of said panel-like members converging with respect to said lower support assembly so that adjacent sheets converge in different directions, said panel-like members providing the sole support for the upper support structure.

2. The furniture support of claim 1 wherein said panel-like members are substantially transparent.

3. The furniture support of claim 1 wherein said panel-like members are trapezoidal with the opposite parallel sides of said trapezoidal panel-like members being affixed to said upper and lower support assemblies.

4. The furniture support of claim 3 wherein said upper and lower support assemblies are parallel to one another.

5. The furniture support of claim 4 wherein said panel-like members are inclined from the vertical at an angle in the range of from 5° to 45° degrees.

6. The furniture support of claim 3 wherein said structure includes four panel-like members, said upper and lower support assemblies being H-shaped with said converging panel-like members being affixed to the connecting cross-bar member of the H in both upper and lower support assemblies, said upper and lower support assemblies being rotated 90° from congruence.

7. A supporting structure comprising:

(a) an H-shaped upper support assembly comprised of two upper supporting members and an upper connecting member, said connecting member being affixed to each of said upper supporting members, (b) an H-shaped lower support assembly comprised of two lower supporting members and a lower connecting member, said connecting member being affixed to each of said lower supporting members, said upper and lower support assemblies being spatially separate with said upper and lower connecting members askew at an angle of about 90°, (c) a first pair of connecting panels having parallel upper and lower edges, said lower edges of said first pair of connecting panels both being affixed to said lower connecting member and said upper edges of said first pair of connecting panels being affixed to opposite upper supporting members;

(d) a second pair of connecting panels having parallel upper and lower edges, said upper edges of said second pair of connecting panels both being affixed to said upper connecting member and said lower edges of said second pair of connecting panels being affixed to opposite lower supporting members.

8. The support member of claim 7 wherein the planes defined by said upper and lower H-shaped support assemblies are parallel to one another.

9. The support structure of claim 7 wherein the first and second pairs of connecting panels are all trapezoids.

10. The support structure of claim 7 wherein the first and second pairs of connecting panels are substantially transparent.

11. A table comprising:

(a) a support structure comprised of:

(i) an H-shaped upper support assembly comprised of two upper supporting members and an upper connecting member, said connecting member being affixed to each of said upper supporting members, (ii) an H-shaped lower support assembly comprised of two lower supporting members and a lower connecting member, said connecting member being affixed to each of said lower supporting members, said upper and lower support assemblies being spatially separate with said upper and lower connecting members askew at an angle of about 90°, (iii) a first pair of connecting panels having parallel upper and lower edges, said lower edges of said first pair of connecting panels both being affixed to said lower connecting member and said upper edges of said panels being affixed to opposite upper supporting members;

(iv) a second pair of connecting panels having parallel upper and lower edges, said upper edges of said second pair of connecting panels both being affixed to said upper connecting member and said lower edges of said second pair of connecting panels being affixed to opposite lower supporting members, (b) a planar upper surface over the upper supporting assembly.

12. The table of claim 11 wherein the planes defined by said upper and lower H-shaped support assemblies are parallel to one another.

13. The table of claim 11 wherein the first and second pairs of connecting panels are all trapezoids.

14. The table of claim 11 wherein the first and second pairs of connecting panels are substantially transparent.

15. The table of claims 11 and 15 wherein said planar upper surface is substantially transparent.

16. The table of claim 11 wherein the cross-section of members comprising both said H-shaped support assemblies is round.

17. The table of claim 16 wherein said planar upper surface and said first and second pairs of connecting panels are substantially transparent.

18. The table of claim 11 wherein said planar upper surface is affixed to said upper supporting assembly.

* * * * *